US010589288B2

(12) United States Patent
Beard et al.

(10) Patent No.: US 10,589,288 B2
(45) Date of Patent: Mar. 17, 2020

(54) CRADLE SYSTEM FOR FRAGMENTATION MACHINES

(71) Applicants: Justin H Beard, Knoxville, TN (US); Bradley O McIntosh, Sneads, FL (US)

(72) Inventors: Justin H Beard, Knoxville, TN (US); Bradley O McIntosh, Sneads, FL (US)

( * ) Notice: Subject to any disclaimer, the term of this patent is extended or adjusted under 35 U.S.C. 154(b) by 740 days.

(21) Appl. No.: 15/138,588

(22) Filed: Apr. 26, 2016

(65) Prior Publication Data

US 2016/0310953 A1 Oct. 27, 2016

Related U.S. Application Data

(60) Provisional application No. 62/152,936, filed on Apr. 26, 2015.

(51) Int. Cl.

| | |
|---|---|
| ***B02C 23/16*** | (2006.01) |
| ***B02C 18/14*** | (2006.01) |
| ***B02C 13/284*** | (2006.01) |
| ***B02C 13/10*** | (2006.01) |
| ***B07B 1/20*** | (2006.01) |
| ***B07B 1/46*** | (2006.01) |
| *B02C 18/16* | (2006.01) |

(52) U.S. Cl.

CPC ..... *B02C 23/16* (2013.01); *B02C 13/10* (2013.01); *B02C 13/284* (2013.01); *B02C 18/14* (2013.01); *B07B 1/20* (2013.01); *B07B 1/46* (2013.01); *B02C 2018/162* (2013.01); *B02C 2023/165* (2013.01); *B07B 2201/02* (2013.01)

(58) Field of Classification Search

CPC ..... B02C 23/08; B02C 23/10; B02C 23/14; B02C 23/16; B02C 18/14; B02C 2018/162; B02C 2023/165; B07B 1/18; B07B 1/20; B07B 1/46; B07B 1/4609; B07B 2201/02

See application file for complete search history.

(56) References Cited

U.S. PATENT DOCUMENTS

| | | | | |
|---|---|---|---|---|
| 6,845,931 | B1 * | 1/2005 | Smith | B02C 13/06 241/294 |
| 7,726,594 | B2 * | 6/2010 | Smith | B02C 13/06 241/294 |
| 2012/0032013 | A1 * | 2/2012 | Rice | B02C 18/145 241/282.2 |
| 2013/0161427 | A1 * | 6/2013 | Hongo | B02C 13/06 241/73 |
| 2015/0231643 | A1 * | 8/2015 | DeBoef | B02C 23/16 241/88.4 |

* cited by examiner

*Primary Examiner* — Charles A Fox
*Assistant Examiner* — Kalyanavenkateshware Kumar
(74) *Attorney, Agent, or Firm* — Luedeka Neely Group, P.C.; Ken Hoffmeister; Rick Barnes

(57) ABSTRACT

A cradle system for a fragmenting machine, where the cradle system holds fragmentation stock against a drum. A frame holds a screen that can be selectively released from the frame without modification, such that the screen can be placed in different positions on the frame and aligned in different orientations on the frame. A wear plate can be selectively released from the frame without modification, such that the wear plate can be placed in different positions on the frame and aligned in different orientations on the frame.

11 Claims, 17 Drawing Sheets

CRADLE SYSTEM FOR FRAGMENTATION MACHINES

This application claims rights and priority on prior U.S. provisional patent application Ser. No. 62/152,936 filed 2015 Apr. 26. This invention relates to the field of fragmenting machines. More particularly, this invention relates to a cradle system for a fragmenting machine.

FIELD

Introduction

Fragmenting machines, such as grinders and chippers, splinter, shred, grind, chip, or otherwise fragment waste or other stock for purposes such as disposal or recycling. Generally, such fragmenting machines include a grinding chamber defined by a grinding drum and screens. The screens, which are seated into a supporting frame, contain and force the stock into contact with the grinding drum during operation. During use, tremendous forces are generated at the point of impact when the stock strikes the screens. Particularly dimensioned openings in the screen allow fragments of the stock that have been reduced to a particular piece size to exit the grinding chamber.

Such conventional screens and the wear plates that are typically disposed at the inlet to the grinding chamber (and possibly elsewhere) are not designed to be user serviceable. The wear plates may have ridges (hard facing such as weld beads) running across the top faces of the wear plates from end to end. After the ridges wear down due to repeated contact with the stock, the body of the wear plate is subject to wear from contact with the stock. When a screen becomes compromised, the lot is at risk of being ruined by an excessive amount of large piece size fragments bypassing the properly dimensioned openings through the damaged portions of the screen.

Due to the high cost and inconvenience of replacing conventional screen and wear plate assemblies, some fragmentation machine operators have resorted to makeshift repair protocols to extend the usable life of the screen and wear plate assemblies. While these makeshift repair protocols allow fragmentation machine operators to defer purchasing new screens and wear plates, making repairs has a measurable cost in terms of productivity. When a screen becomes compromised or the ridges of the wear plate are worn down, operation of the fragmentation machine is stopped and at least one of the screen and the wear plate is repaired.

This makeshift repair process is time consuming. Generally, the screens must first be removed and the wear plate cut or otherwise removed from the frame. The weight of conventional screens necessitates the use of a hoist or other device to lift the damaged screen off of the frame and transport it to a repair area. Typically many people are required to manipulate the damage screen due to its size and weight.

The actual screen repair involves welding patch plates onto the screen to cover the enlarged openings. Once repaired, the patched screen is transported back to the frame using the hoist. Finally, the patched screen is re-seated into the frame. Instead of removing the screens, the entire frame can be moved to the repair location. However, this repair option requires heavier equipment and more room for the repair.

In the case of worn ridges on the wear plate, technicians must rebuild the weld beads on the wear plates. While worn ridges do not risk contamination of the finished fragmented lot of stock, continuing to operate the fragmentation machine with worn ridges results in direct damage to the cradle and increases the frequency with which cradles must be replaced. Thus, repairing worn ridges is often performed at the end of a shift or during stoppages for screen repair.

The downtime incurred when making repairs reduces the effective throughput of the fragmentation machine. In addition, each solid patch plate that is welded onto the screen restricts flow and further reduces the effective throughput of the fragmentation machine. While financially beneficial to some degree in the short run, the repairs also contribute to the degradation of the screens and the frame due to heating and cooling occurring during the welding process.

Ultimately, repair or replacement of conventional screens and wear plates is time consuming and costly for the fragmentation machine owner.

What is needed, therefore, is a fragmentation system that reduces issues such as those described above, at least in part.

SUMMARY

The above and other needs are met by a cradle system for a fragmenting machine, where the cradle system holds fragmentation stock against a drum. A frame holds a screen that can be selectively released from the frame without modification, such that the screen can be placed in different positions on the frame and aligned in different orientations on the frame. A wear plate can be selectively released from the frame without modification, such that the wear plate can be placed in different positions on the frame and aligned in different orientations on the frame.

In various embodiments, the frame defines a leading grinding edge at one end of the frame, and the wear plate can be selectively retained on the frame in a first orientation where a first edge of the wear plate is toward the leading grinding edge, and a second orientation where the first edge of the wear plate is away from the leading grinding edge. In some embodiments, the frame defines a leading grinding edge at one end of the frame, and a trailing grinding edge at another end of the frame, and the wear plate can be selectively released from the frame at the leading grinding edge of the frame and selectively retained on the frame at the trailing grinding edge of the frame.

In some embodiments, the frame can selectively retain a plurality of screens in a plurality of different positions on the frame, and any one of the screens can be placed and selectively retained in any one of the positions on the frame. In some embodiments, the screen is selectively retained to the frame by hooks connected to a shaft that is rotatably mounted to the frame, where the hooks selectively engage and disengage a retaining bar mounted to the screen as the shaft is rotated, and the screen is selectively released from and retained on the frame by rotating the shaft.

In some embodiments, the wear plate is selectively retained to the frame by posts mounted on a back surface of the wear plate, which posts engage retaining sockets fixedly mounted to the frame. In some embodiments, the wear plate is sized to be carried by one person without assistance. In some embodiments, the screen is sized to be carried by one person without assistance.

According to another aspect of the invention there is described a cradle system for a fragmenting machine, where the cradle system holds fragmentation stock against a drum. A frame has a leading grinding edge and a trailing grinding edge. Retaining sockets are fixedly mounted to the frame in a first position proximate the leading grinding edge and a second position proximate the trailing grinding edge. Shafts are rotatably mounted to the frame, where each shaft has a series of hooks that rotate with the shaft as the shaft rotates. The system includes screens, where each screen has at least one mounting rod, and each of the screens can be selectively placed into any one of different positions on the frame. The screens are selectively retained on and released from the frame by rotating the shafts such that the hooks selectively engage and disengage the mounting rods. A first wear plate has retaining posts that releasably engage the retaining sockets in the first position, and a second wear plate also has retaining posts that releasably engage the retaining sockets in the second position. The first and second wear plates are swappable between the first position and the second position.

In various embodiments according to this aspect of the invention, each of the wear plates have a first edge, and the wear plates can both be rotated such that the first edge of each wear plate is selectively disposed toward one of the leading grinding edge and the trailing grinding edge. In some embodiments, each of the wear plates is sized to be carried by one person without assistance. In some embodiments, each of the screens is sized to be carried by one person without assistance.

DRAWINGS

Further advantages of the invention are apparent by reference to the detailed description when considered in conjunction with the figures, which are not to scale so as to more clearly show the details, wherein like reference numbers indicate like elements throughout the several views, and wherein.

DESCRIPTION

A cradle system 100 for use with fragmenting machines 102 is described herein and illustrated in the accompanying figures.

Figure 1:
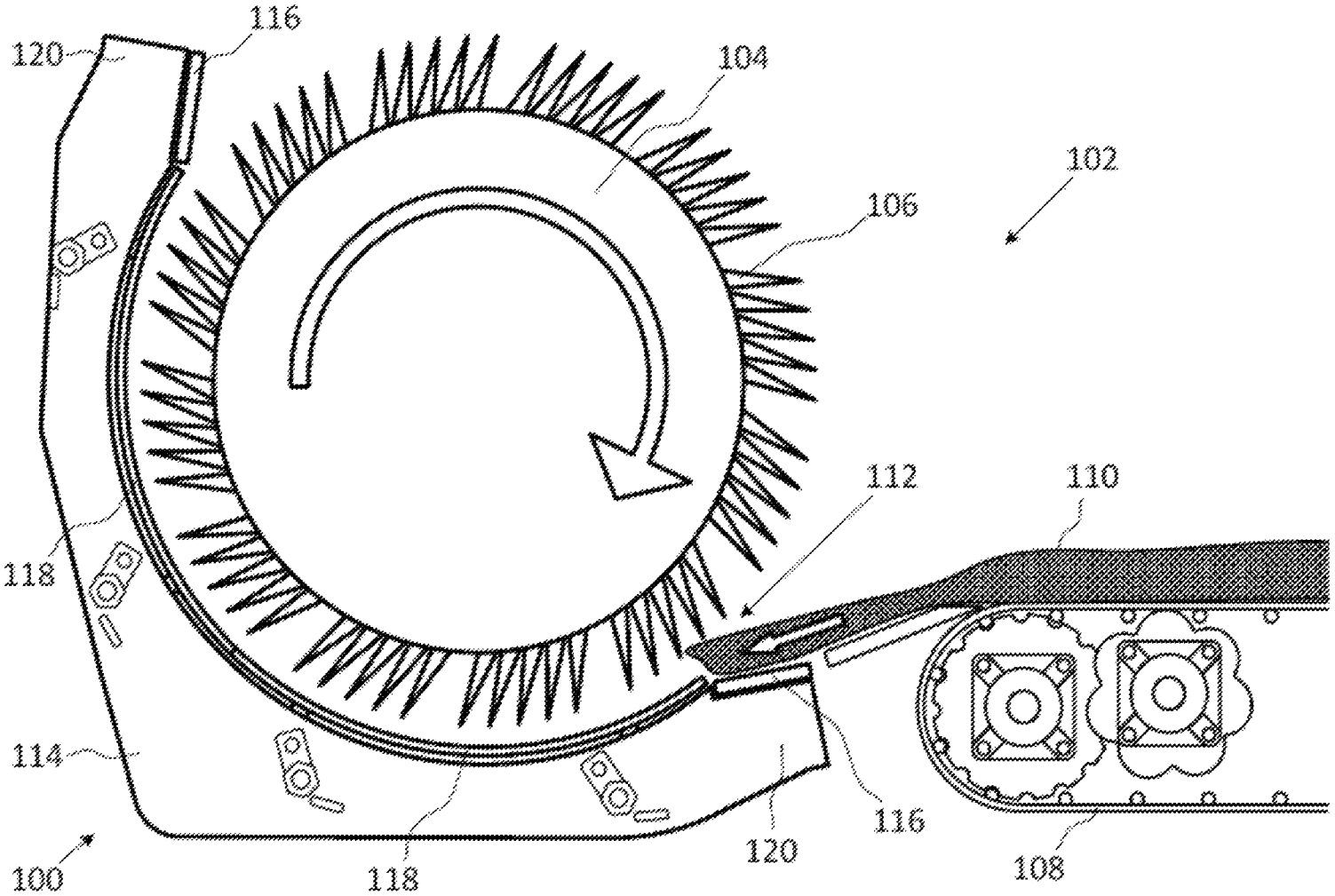
FIG. 1 depicts a side elevation view of a portion of a fragmenting machine with a cradle system according to an embodiment of the present invention.

FIG. 1 is an illustration of an embodiment of the cradle system 100 in a representative fragmentation machine 102. In the illustration, the representative fragmentation machine 102 is a horizontal grinder. The horizontal grinder 102 includes a rotating drum 104 having multiple teeth 106. A conveyor 108 feeds a stock 110, such as asphalt shingles or wood scraps, to the horizontal grinder 102 at an entry point 112 to the fragmentation chamber. The stock 110 has a nominal starting piece size that is generally larger than a target piece size. As the drum 104 spins, the teeth 106 break the larger pieces of the stock 110 into smaller pieces.

The cradle system 100 partially surrounds the drum 104 to contain the stock 110 during fragmentation. The space between the cradle system 100 and the drum 104 generally defines the fragmentation chamber. The cradle system 100 includes a cradle 114, one or more wear plates 116, and one or more screens 118. The cradle 114 provides a supporting framework for the screens 118. The wear plates 116 are located at one or both ends 120 of the cradle 114. In particular, one wear plate 116 is located at the end 120 of the cradle 114 associated with the entry point 112 into the horizontal grinder 102.

The screens 118 include a plurality of openings that allow pieces of the stock 110 that have been reduced to the target piece size (or smaller) to pass through to a collector. For example, the collector may include additional conveyors that carry the reduced stock 110 to a storage location (a storage pile or container), or an exchangeable container that catches finished fragments and is exchanged with another container when full. Generally, the finished fragments are collected into a lot measured in a selected unit (tons or cubic yards).

The cradle system 100 is not meant to be limited to use with one particular fragmentation machine 102, including the horizontal grinder described herein. Instead, the cradle system 100 has utility with any comminuting or fragmenting machine 102 using a powered rotary drum 104 designed to reduce stock 110 to a desired particle size measured by a filtering screen 118.

Figure 2:
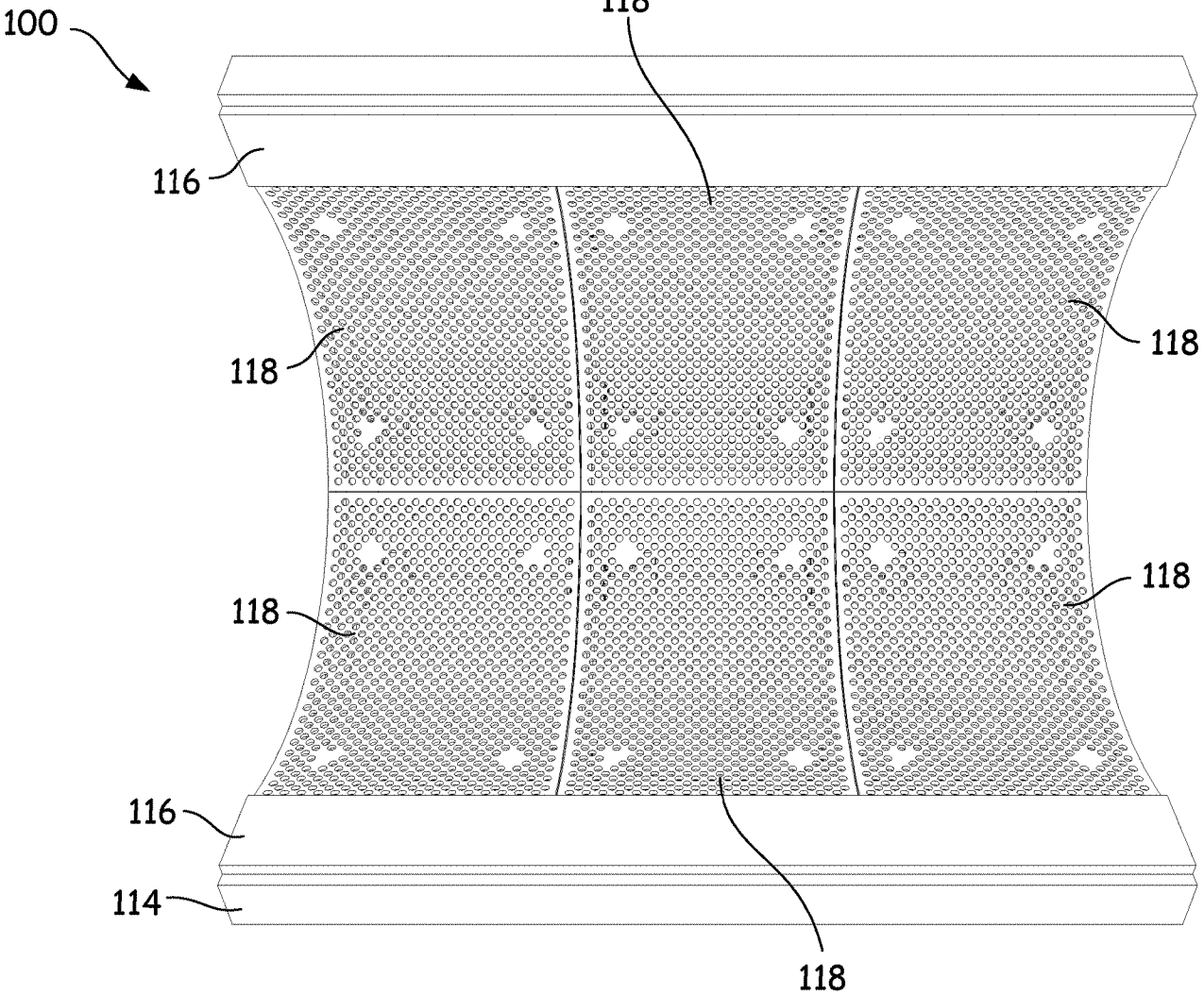
FIG. 2 depicts a front elevation view of a cradle system according to an embodiment of the present invention.

FIG. 2 is a front elevation view of one embodiment of the cradle system 100 for use with fragmentation machines 102. The wear plates 116 and the screens 118 cover the cradle 114 and serve to insulate the cradle 114 from direct contact with the stock 110. In the illustrated embodiment, the cradle 114 is shown with six screens 118. Over time, repeated contact with the stock 110 results in wear on the wear plates 116 and the screens 118. The wear plates 116 tend to experience wear on the front edge and the inner face (the side facing towards the drum 104). The screens 118 tend to experience wear on the surface facing the drum 104 and at the edges of the openings through the screen 118. With highly abrasive stock 110, such as asphalt shingles, the wear on the wear plates 116 and the screens 118 is particularly accelerated.

The fundamental consequence of wear on the screens 118 is that openings through the screen 118 become enlarged. Enlargement of the openings is typically due to mechanical failure of the material between one or more openings as a result of factors including, but not limited to, the intense forces generated by the grinding drum 104 applied when the stock 110 strikes the screens 118, and the abrasiveness of the stock 110 that is engaging the screens 118. This results in the separate and specifically dimensioned openings that were once defined to be joined into a larger opening.

The larger opening allows pieces of the stock 110 that are bigger than the target piece size to pass through to the collector 120. Allowing too many fragments that are bigger than the target piece size to reach the collector 120 is often problematic. For example, in a commercial transaction, the entire lot may be rejected by a buyer or the purchase price reduced when a selected percentage of the finished fragments in a lot have an average piece size that exceeds the target piece size. Similarly, in a disposal scenario, the lot may be refused at a waste disposal site or the disposer may be assessed additional fees or penalties.

Figure 3:
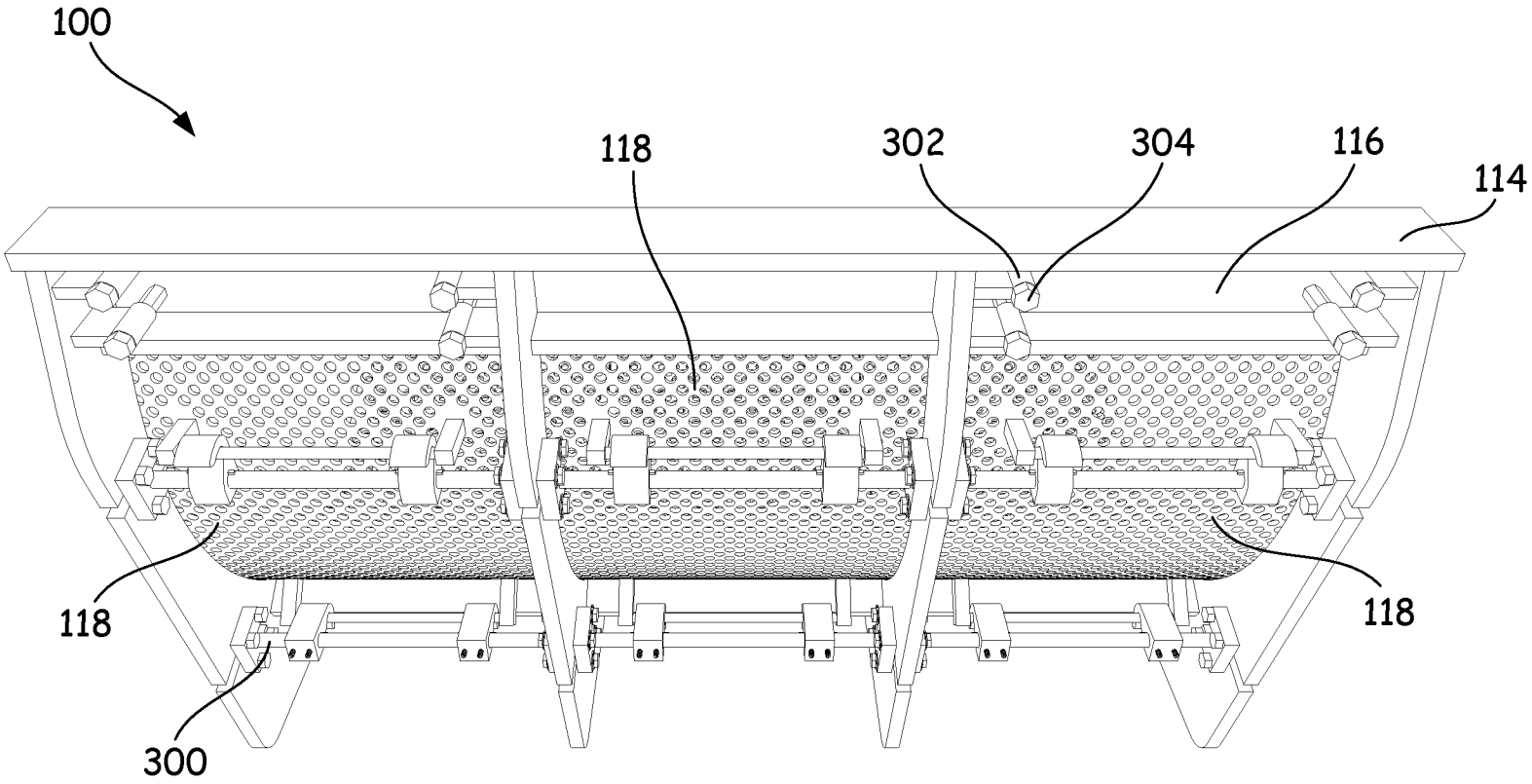
FIG. 3 depicts a rear elevation view of a cradle system according to an embodiment of the present invention.
Figure 4A:
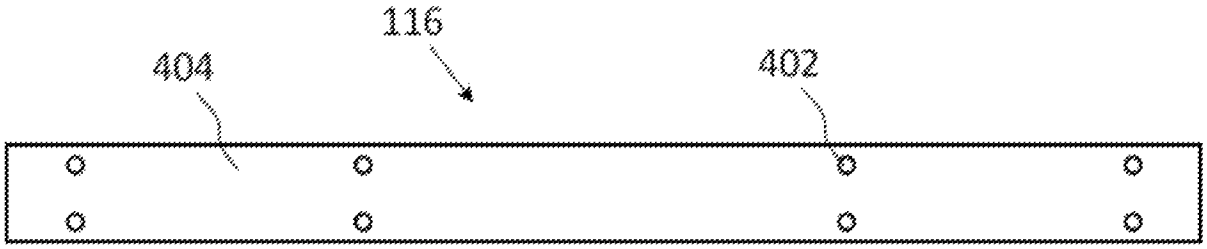
FIG. 4A depicts a rear elevation view of a wear plate according to an embodiment of the present invention.
Figure 4B:
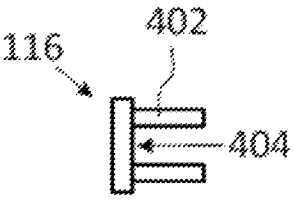
FIG. 4B depicts a side elevation view of a wear plate according to an embodiment of the present invention.
Figure 4C:
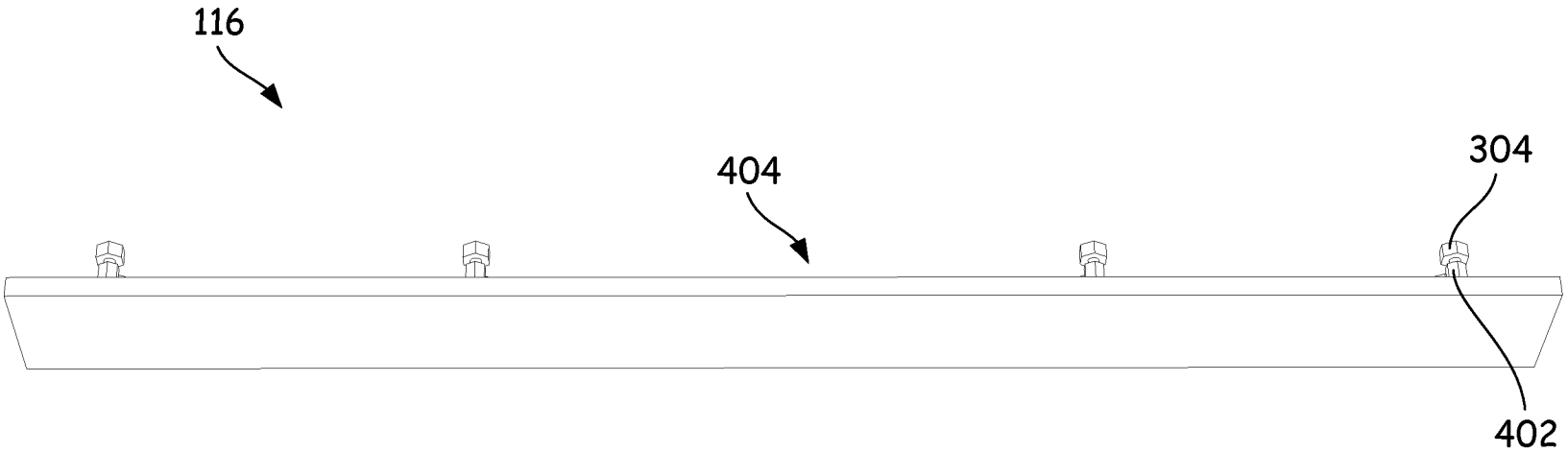
FIG. 4C depicts a perspective view of a wear plate according to an embodiment of the present invention.
Figure 4D:
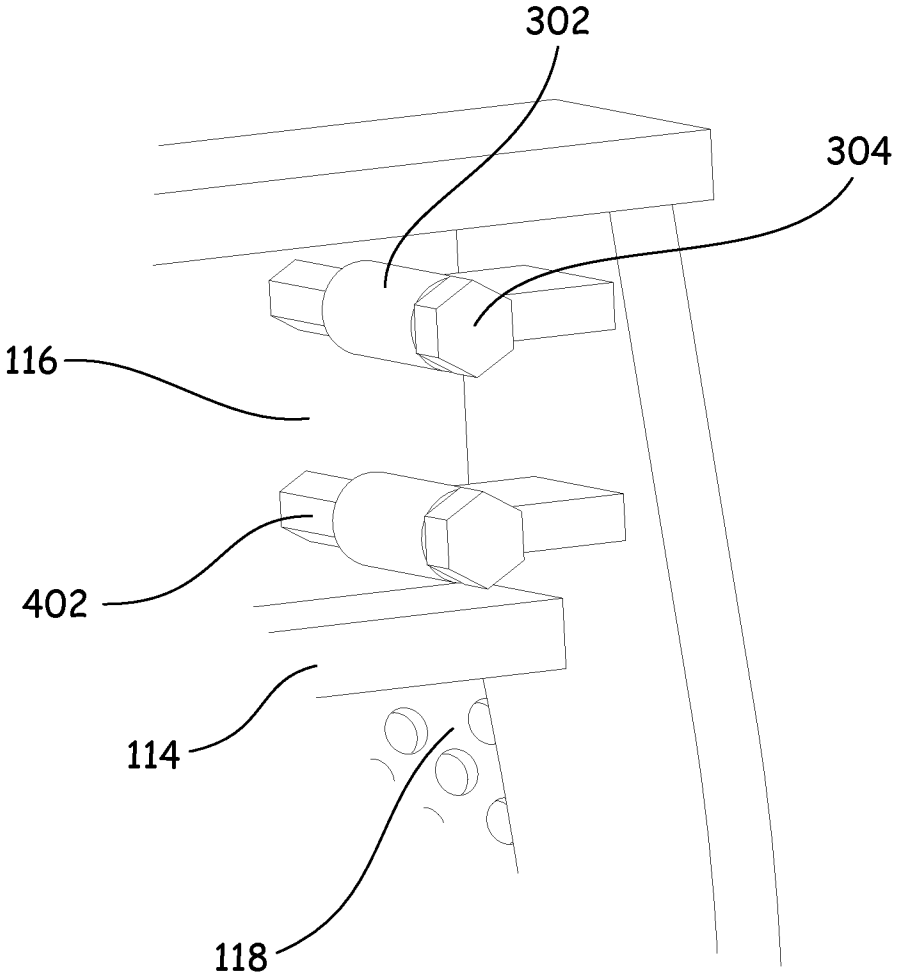
FIG. 4D depicts a perspective view of a wear plate attached to a frame according to an embodiment of the present invention.

FIG. 3 is a rear elevation view of an embodiment of the cradle system illustrating various aspects of an embodiment of the present invention. In contrast to the conventional screen 118 and frame 114 assemblies, the wear plates 116 and the screens 118 of the cradle system 100 are designed to be readily serviceable by an individual, and thereby to reduce or minimize downtime. Accordingly, the cradle 114 includes latch mechanisms 300 that releasably secure the screens 118 to the cradle 114. The cradle 114 also includes a number of a mounting sockets 302 used to releasably mount the wear plates 116 to the cradle 114 using non-permanent fasteners 304.

FIGS. 4A to 4D illustrate aspects of the wear plate 116. The wear plate 116 includes a set of mounting studs 402 extending outwardly from the rear face 404 of the wear plate 116. In use, the mounting studs 402 are aligned with the corresponding mounting sockets 302 on the cradle 114, and are selectively secured in place by inserting the fastener 304 through the mounting sockets 302 and into the mounting studs 402. Examples of suitable non-permanent (removable), but secure, fasteners include, without limitation, locking pins and threaded bolts. In the illustrated embodiment, the mounting studs 402 are internally threaded with female threads receiving a threaded bolt 304. The mounting sockets 302 are optionally threaded. Alternatively, the mounting stud 402 is a threaded bolt that passes through an unthreaded mounting socket 302 and is secured using a threaded nut 304 or similar fastener.

As previously mentioned, the leading edge or side of the wear plates 116 (the edge receiving the rotational direction of the drum 104 or facing the conveyor 108) generally wears faster than the opposite edge or side. The mounting studs 402 are symmetrically arranged on the mounting plate 116 so the spacing is identical regardless of the orientation of the wear plate 116. Similarly, the mounting sockets 302 are symmetrically arranged on the cradle 114. This allows the wear plates 116 to be rotated such that the trailing edge or rear side becomes the leading edge or front side of the wear plate 116, thereby extending the usable life of the wear plate 116 (nominally doubling the usable life) without requiring any repair of the wear plate 116.

The number of mounting studs 402 and mounting sockets 302 vary from one embodiment to another, in order to provide for a secure mount for the wear plate 116. However, using the minimum number of mounting studs 402 and mounting sockets 302 to secure each wear plate 116 to the cradle 114 facilitates faster removal and remounting of the wear plates 116. The number of mounting studs 402 is typically equal to the number of mounting sockets 302 on the cradle 114, but equal numbers are not required.

Figure 5:
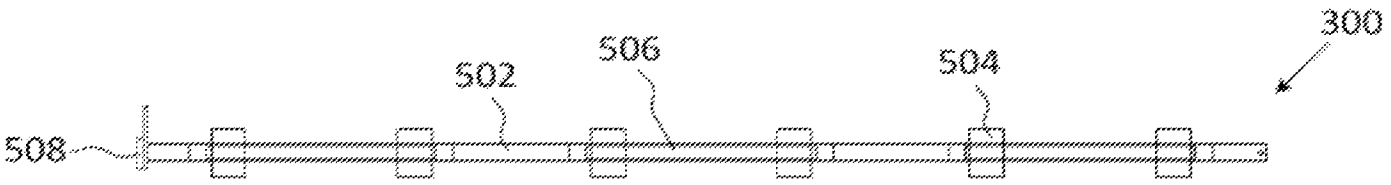
FIG. 5 depicts a latch mechanism used to releasably secure the screens to the cradle according to an embodiment of the present invention.

FIG. 5 is a plan view illustrating aspects of the latch mechanism 300 that is used to releasably secure the screens 118 to the cradle 114. The latch mechanism 300 includes a shaft 502 that carries one or more hook-shaped latches 504. The illustrated embodiment of the shaft 502 includes optional alignment tabs 506 that extend outwardly from the shaft 502. The alignment tabs 506 ensure that the latches 504 are properly aligned, and serve to hold the latches 504 in the proper orientation during operation. A latch actuator 508 is used to rotate the latches 504 via the shaft 502 to selectively bring the latches 504 into engagement with the screens 118 for securing the screens 118 to the cradle 114, and to selectively disengage the latches 504 from the screens 118, allowing the screens 118 to be removed from the cradle 114.

Figure 6A:
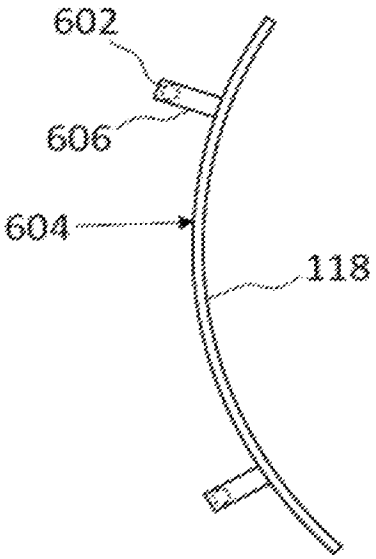
FIG. 6A depicts a side elevation view illustrating various aspects of the screen according to an embodiment of the present invention.
Figure 6B:
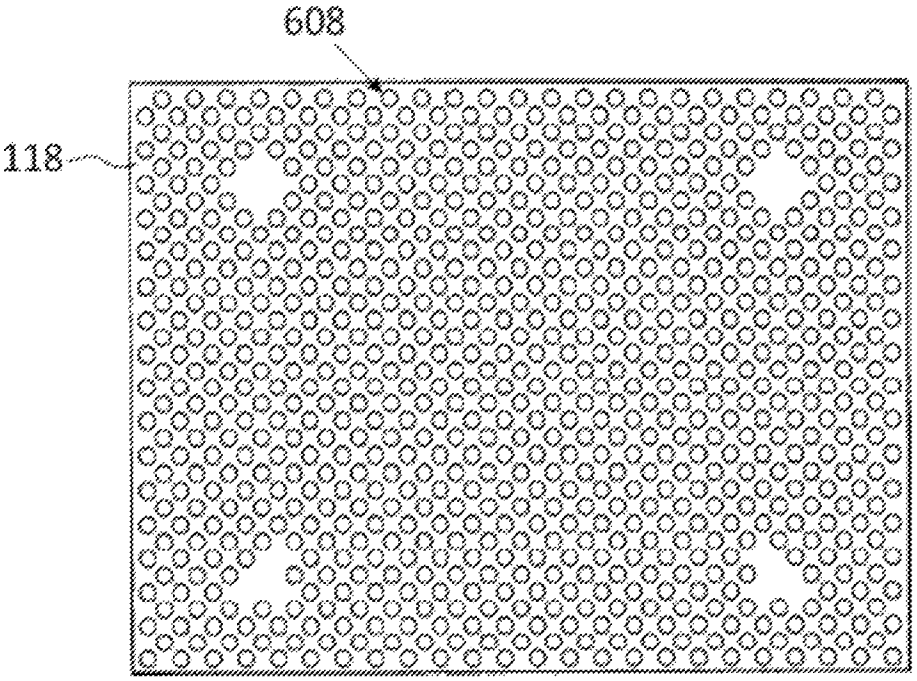
FIG. 6B depicts a front elevation view illustrating various aspects of the screen according to an embodiment of the present invention.
Figure 6C:
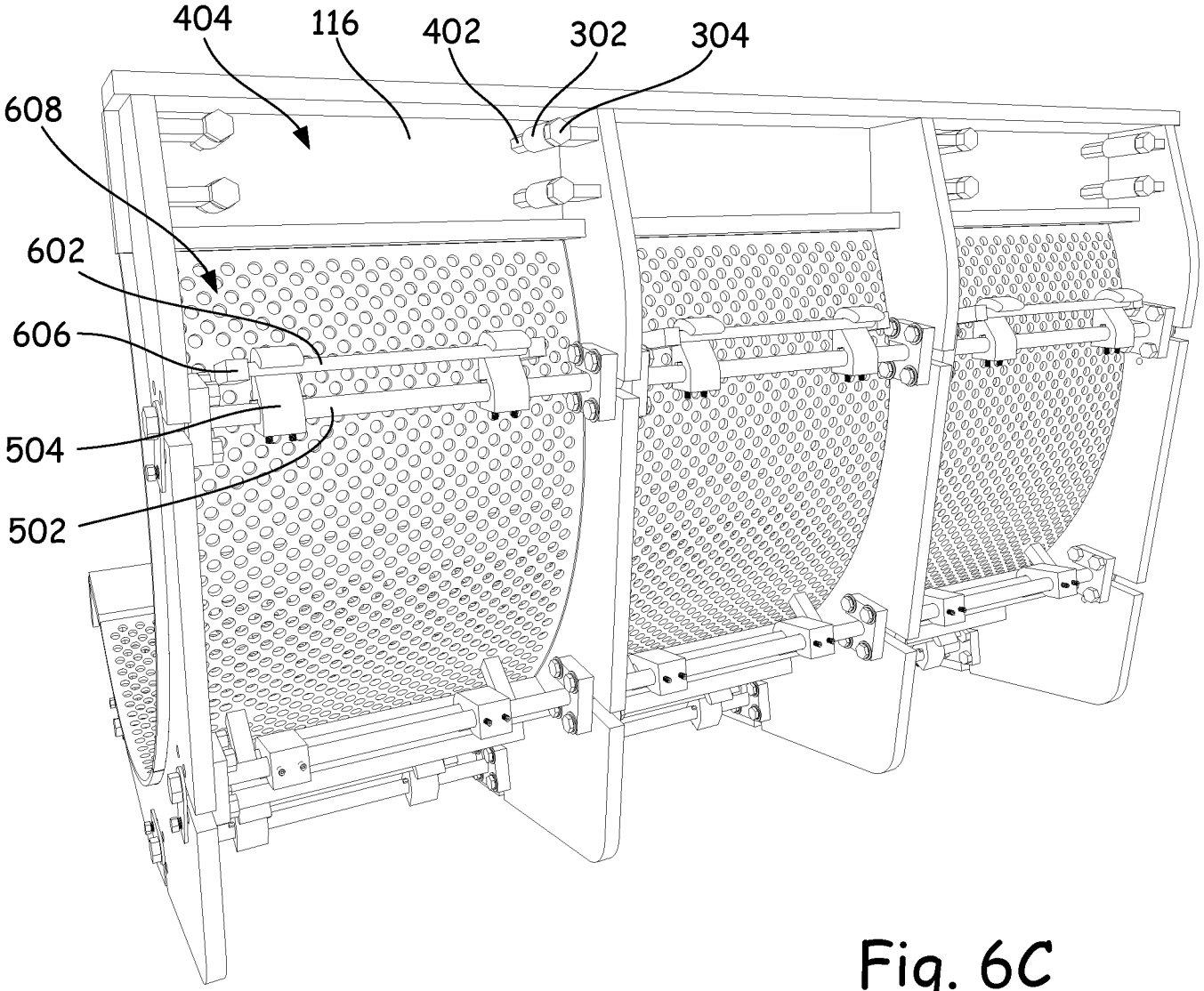
FIG. 6C depicts a perspective view of a portion of the rear of the cradle system illustrating various aspects of the screen and the latch mechanism according to an embodiment of the present invention.

FIGS. 6A to 6C illustrate aspects of the screens 118 according to the depicted embodiment. Each screen 118 generally has a concave shape facing into the drum 104, and includes one or more latch bars 602 (shown in phantom in FIG. 6A) attached to the rear 604 of the screen 118. The latch bars 602 are engaged by one or more of the latch hooks 504 to secure the screen 118 to the cradle 114. The latch bars 602 are held away from the rear of the screen 604 by a set of arms 606 to provide clearance for the latches 504. In the illustrated embodiment, the screen 118 has two latch bar assemblies.

Furthermore, each screen 118 defines multiple particularly dimensioned openings 608 allowing the screen 118 to filter fragments of stock 110 based on piece size. As the size of the stock 110 is reduced by interaction with the drum 104, fragments small enough to fit through the dimensions of the openings 608 pass through the screen 118 and exit the fragmentation chamber as finished fragments. Larger fragments continue to be contained within the fragmentation chamber by the screen 118 and are further reduced. As previously mentioned, a major exception to this general principle of operation occurs when the screen 118 is damaged and openings become enlarged, which allows fragments bigger than the target piece size to escape the fragmentation chamber.

As with the wear plates 116, the screens 118 are also subject to uneven wear by virtue of the rotational movement of the stock 110. The shape of the screens 118 and the arrangement, positioning, and symmetrical nature of the latch bars 602 and the latch mechanism 300 allows the screens 118 to be rotated to extend the life to the screens 118.

Figure 7:
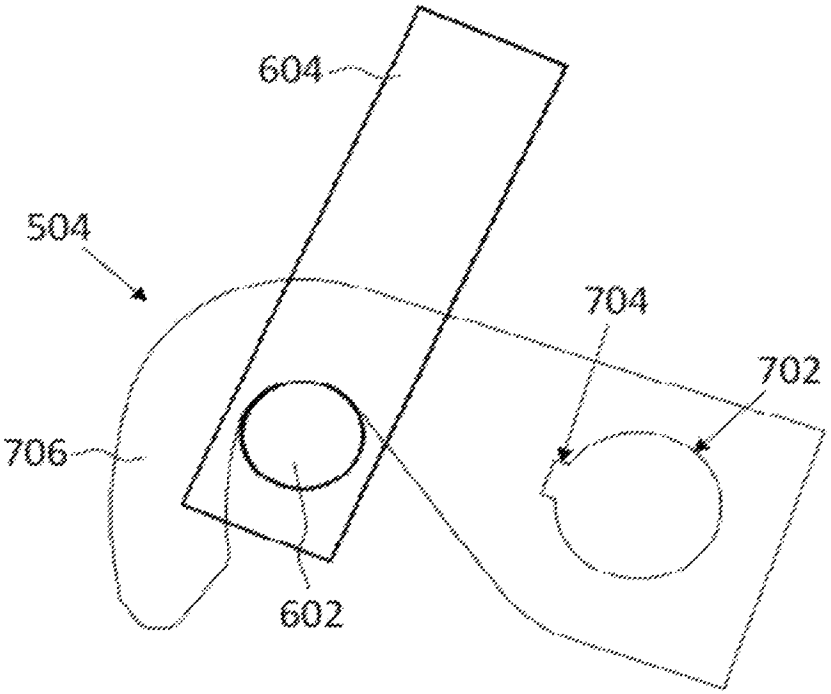
FIG. 7 depicts a side elevation view illustrating aspects of a latch hook according to an embodiment of the present invention.

FIG. 7 is a side elevation view illustrating aspects of the latches 504 according to the depicted embodiment. The body of each latch hook 504 defines a through opening 702 through which the shaft 502 of the latch mechanism 300 passes. When so installed, the shaft 502 serves as the rotation axis for the latch 504. The through opening 702 includes a keyway 704 that registers with the alignment tab 506 on the shaft 502 to properly align the latch 504 and prevent rotation of the latch 504 about the shaft 502. The end of the latch defines a hook 706 that captures the latch bar 602, as show in the illustrated embodiment, when the shaft 502 is rotated by the latch actuator 508 to bring the latch hook 504 into engagement with the latch bar 602.

In the illustrated embodiment, the latch actuator 508 is a locking nut. Such an actuator 508 provides a relatively low profile, but generally requires an external tool, such as a wrench or a ratchet (hand or powered), to generate sufficient force to rotate the shaft 502. Various embodiments of the latch actuator 508 include a handle or a gear arrangement that provide a mechanical advantage, and allow the shaft 502 to be rotated without resorting to an external tool or a motor driven actuator 508 that provides sufficient torque to rotate the shaft 502.

Figure 8:
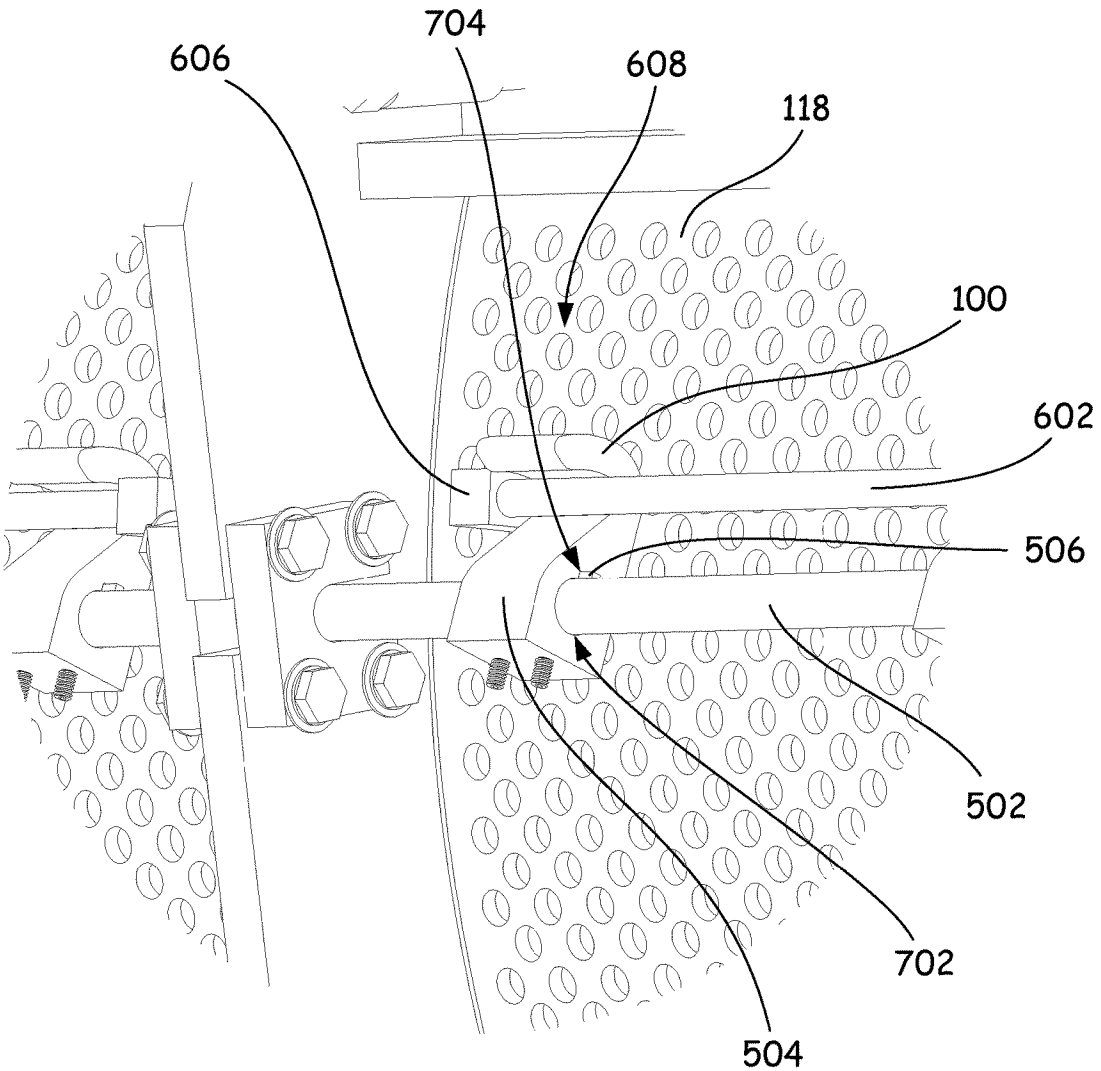
FIG. 8 depicts a perspective view of a portion of the rear of the cradle system depicting various aspects of a latch mechanism engaging a latch bar so as to secure a screen to a cradle according to an embodiment of the present invention.

FIG. 8 is a perspective view depicting aspects of the latch mechanism engaging the latch bar 602 in order to secure the screen 118 to the cradle 114.

Figure 9:
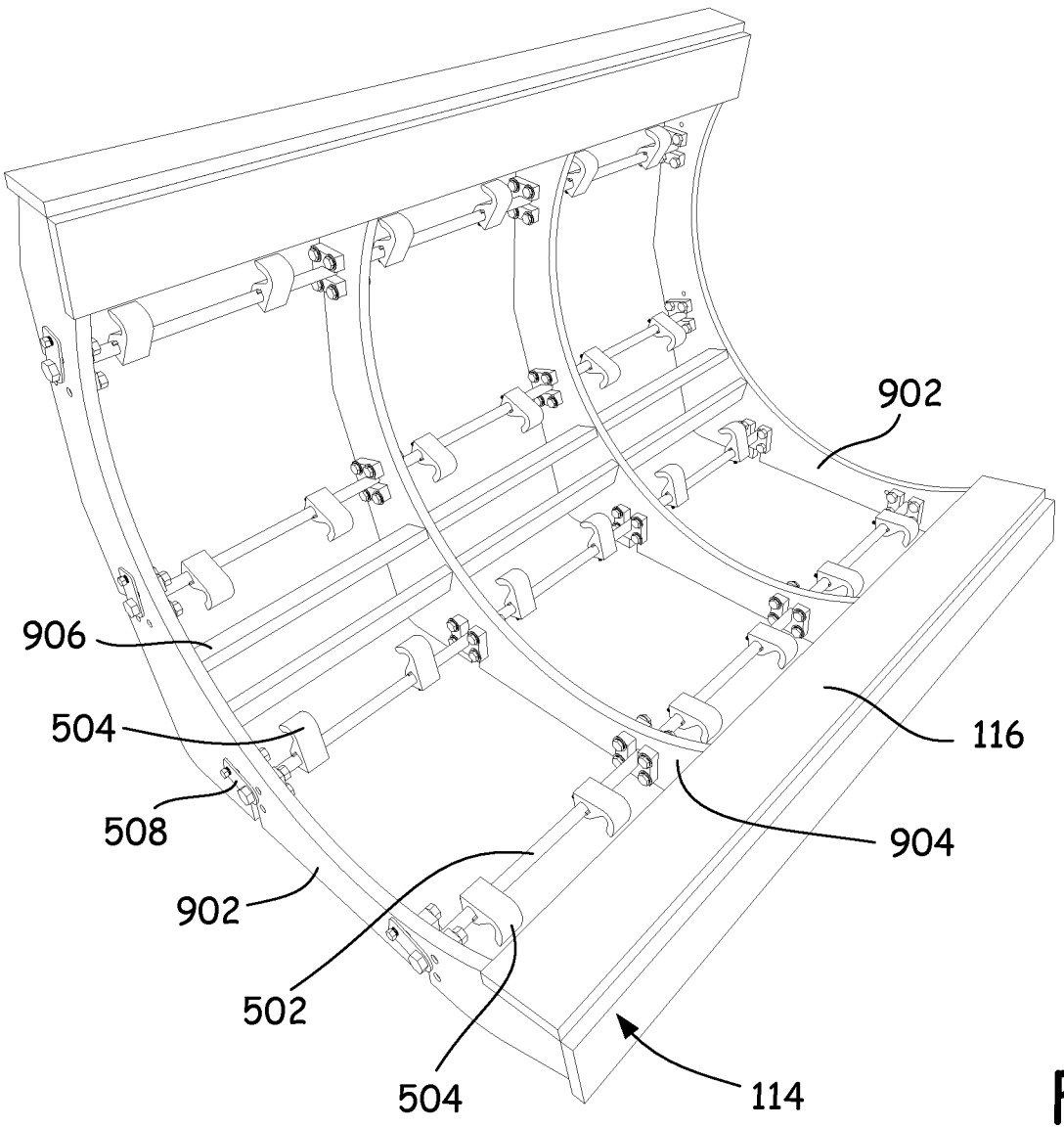
FIG. 9 depicts a perspective view of a portion of the cradle system, viewed from the front, depicting various aspects of the latch mechanism installed in the cradle with the screens removed for clarity according to an embodiment of the present invention.

FIG. 9 is a perspective view depicting aspects of the latch mechanism installed in the cradle 114 with the screens 118 removed for clarity. Various embodiments of the cradle 114 include sides 902, ribs 904, and cross-members 906 that provide structural support for multiple screens 118. In the illustrated embodiment, the two ribs 904 and the two central cross-members 906 divide the cradle 114 into six regions, with each region supporting a separate screen 118.

The separate screens 118 are smaller and, therefore, lighter than the conventional screens currently used with fragmentation machines. Further, the configuration of the latch arm assemblies also makes them available for use as handles when a person is carrying the screen 118. These features facilitate ease of maintenance because the reduced weight generally eliminates the need for a hoist to lift and move a screen 118, and reduces the number of people needed to manipulate the screen 118. The reduced size and weight allows a single person to remove a damaged screen 118 and replace it or manipulate it to make repairs. The latch mechanism 300 allows screens 118 to be readily removed and attached without the need to resort to time consuming and destructive techniques, such as welding. As a result, the cradle system 100 vastly improves the effective productivity of the fragmentation machine 102 by facilitating rapid replacement or repair of damaged parts with less downtime. Furthermore, the symmetry of the parts allows them to rotated or reversed to even out wear, thereby extending the useful life the components of the cradle system 100 well beyond that obtainable with a conventional screen welded to a frame.

The cradle system 100 typically includes a latch mechanism 300 for each latch bar assembly provided by the screens 118. The latch mechanisms 300 extend across the width of the cradle 114 and through the neighboring regions. Thus, in the illustrated embodiment, there are two latch mechanisms for the bottom three regions and two additional latch mechanisms for the upper three regions. A number of latch hooks 504 are deployed within each region along the shaft 502. The number of latch hooks 504 deployed in each region may vary based on factors, such as and without limitation, the size of the screen 118, the weight of the screen 118, and the forces generated by the fragmenting machine.

Some embodiments orient the latch hooks 504 on the two latch mechanisms within the same region with the open ends of the hooks 706 facing in opposite directions. The opposing forces increase the tension on the screen 118, which tends to hold the screen 118 more securely. However, facing the latch hooks 504 in opposite directions is not a requirement for suitable operation of the cradle system 100.

Figure 10:
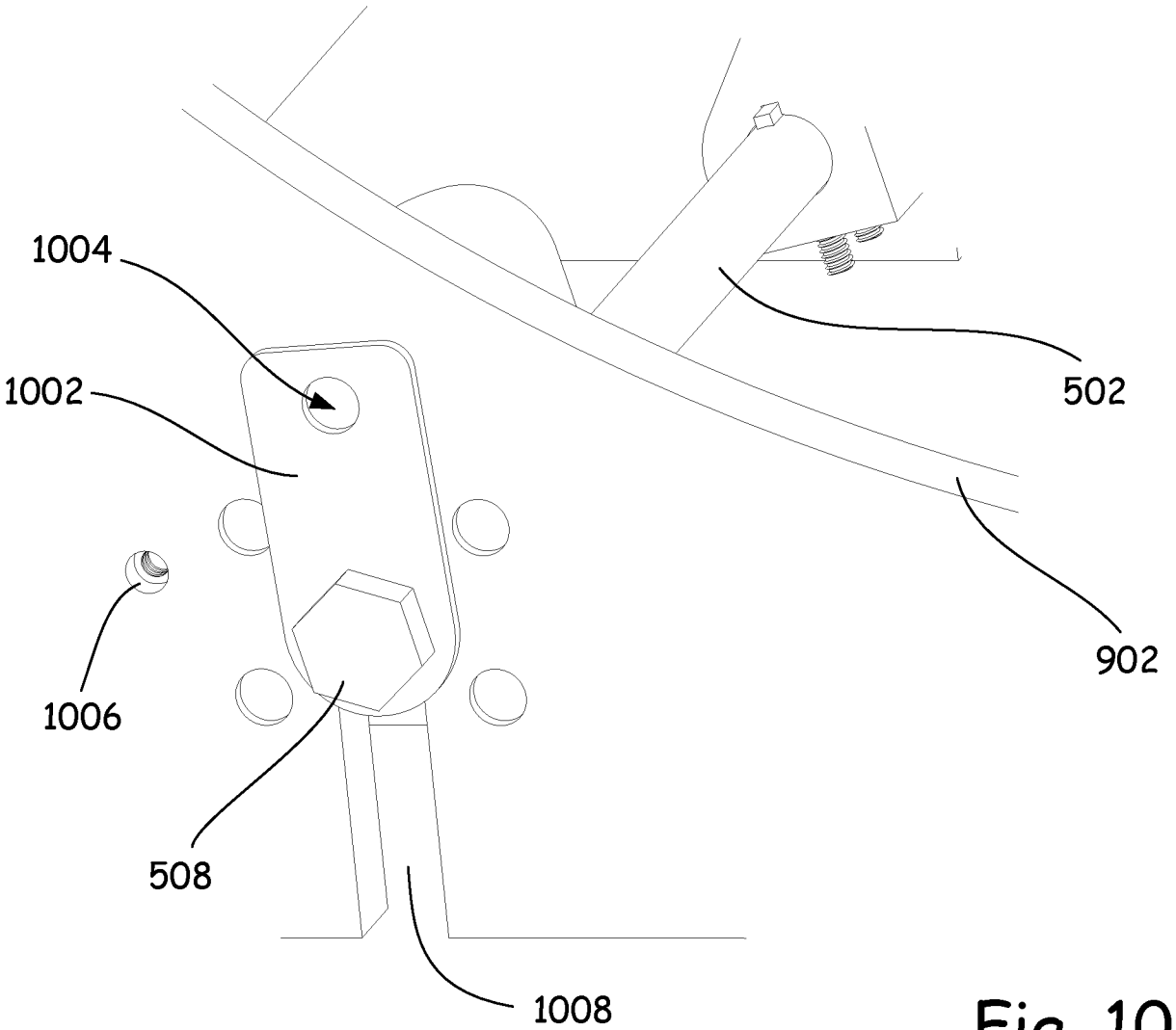
FIG. 10 depicts a perspective view of a portion of the cradle system, viewed from the side, illustrating various aspects of the latch mechanism according to an embodiment of the present invention.

FIG. 10 is a perspective view of a portion of the cradle system 100 illustrating aspects of the latch mechanism according to the depicted embodiment. The latch mechanism 300 includes a lock plate 1002 that defines a pin opening 1004. The lock plate 1002 is fixedly connected to and rotates with the shaft 502.

The outside face of the side 902 of the cradle 114 defines one or more receptacles 1006 at the same radial distance from the rotation axis defined by the shaft 502 as is the pin opening 1004. In other words, the receptacles 1006 lie along the radial path traveled by the pin opening 1004. At least one of the receptacles 1006 is positioned at the point where rotation of the shaft 502 brings the latch hooks 504 into operative engagement with the latch bars 602 of the screens 118. Aspects of the latch mechanism 300 include the use of a stop 1008 that is configured to make contact with or otherwise engage the latch actuator 508 or the lock plate 1002 to limit the travel (rotation) of the shaft 502 in one or both directions, typically the direction that disengages the latch hook 504 from the latch bar 602.

Figure 11:
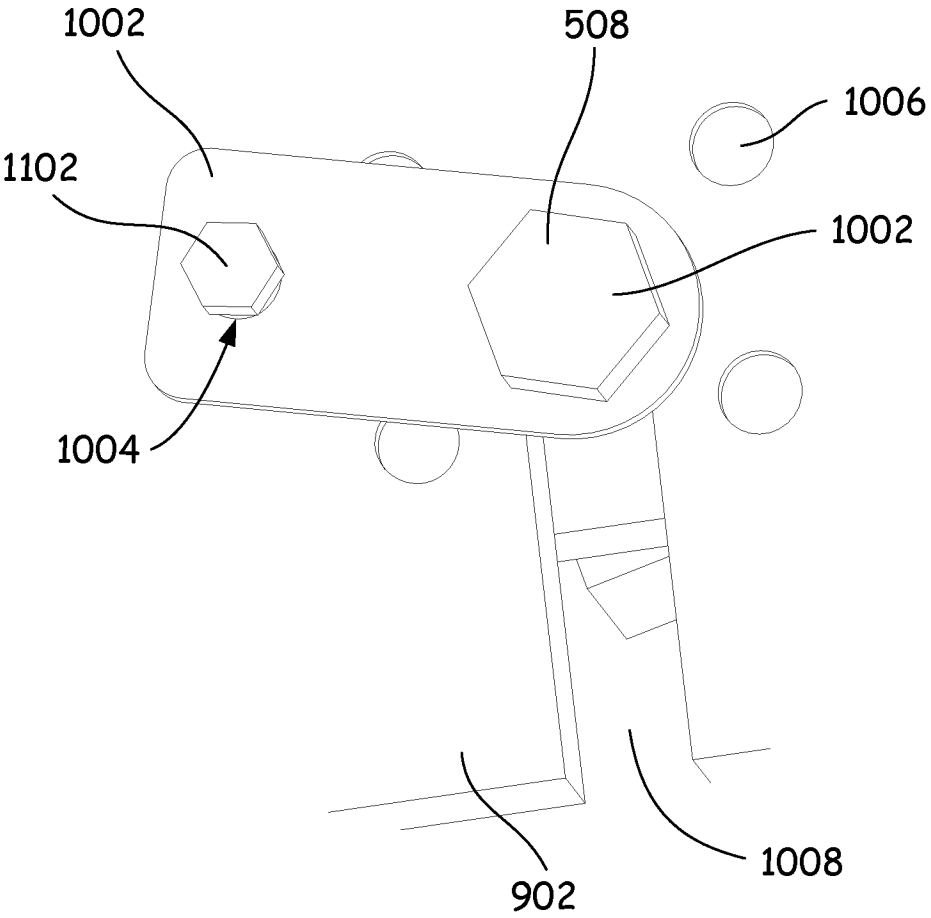
FIG. 11 depicts a perspective view of a portion of the cradle system, viewed from the side, illustrating various aspects of the actuator and lock of the latch mechanism according to an embodiment of the present invention.

FIG. 11 illustrates the latch mechanism locked into place. For example, when the latch hooks 504 are placed into engagement with the latch bars 602 of the screens 118, the pin opening 1004 is aligned with one of the receptacles 1006. A pin 1102 is inserted into and secured within the aligned pin opening 1004 and receptacle 1006 thereby preventing further rotation of the shaft 502 until the pin 1102 is removed. This secures the latch mechanism 300 from becoming unintentionally disengaged.

In some embodiments, the pin 1102 is a threaded fastener, such as a bolt or screw, that passes through the pin opening 1004 and the receptacle 1006 is a female threaded receptacle that couples with the threaded fastener 1102. Optionally, the pin opening 1004 may be threaded and operatively engage the pin 1102 as well. Other suitable fastening arrangements include, without limitation, a locking pin such as spring biased pin or a cotter pin used without a threaded receptacle 1006 or pin opening 1004. Similarly, a separate fastener part, such as a wing nut or bolt, may be used to secure a threaded fastener without requiring the receptacle 1006 or pin opening 1004 to be threaded.

Figure 12:
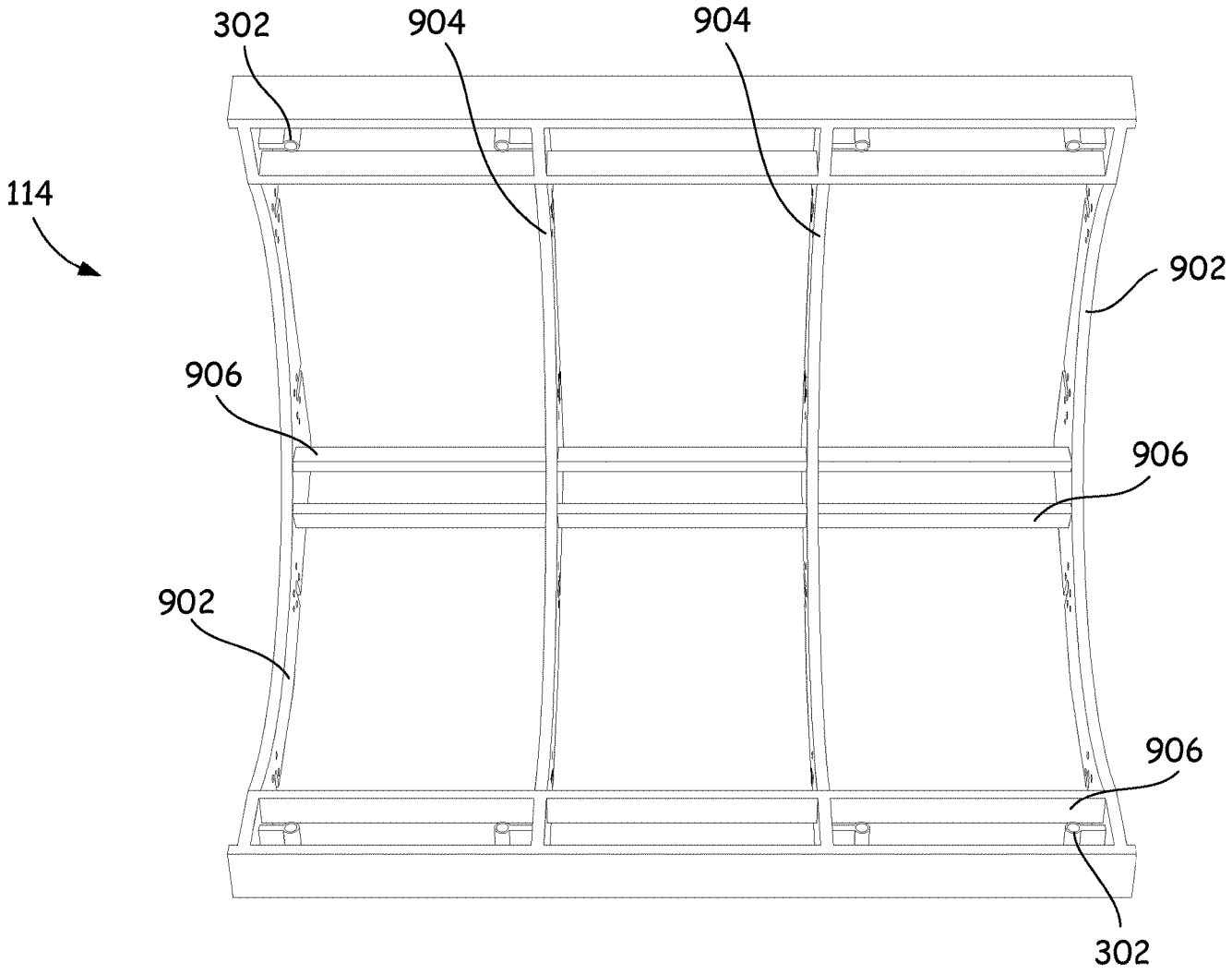
FIG. 12 depicts a front elevation view illustrating aspects of the cradle according to an embodiment of the present invention.

FIG. 12 is a view of an embodiment of the cradle 114 without other components of the cradle system providing a clear view of the cradle 114 skeleton and illustrating various aspects of the cradle 114.

The foregoing description of embodiments for this invention has been presented for purposes of illustration and description. It is not intended to be exhaustive or to limit the invention to the precise form disclosed. Obvious modifications or variations are possible in light of the above teachings. The embodiments are chosen and described in an effort to provide illustrations of the principles of the invention and its practical application, and to thereby enable one of ordinary skill in the art to utilize the invention in various embodiments and with various modifications as are suited to the particular use contemplated. All such modifications and variations are within the scope of the invention as determined by the appended claims when interpreted in accordance with the breadth to which they are fairly, legally, and equitably entitled.

The invention claimed is:

1. A cradle system for a fragmenting machine, the cradle system for holding fragmentation stock against a drum, and comprising:

a frame, a screen that can be selectively released from the frame without modification, such that the screen can be placed in different positions on the frame and aligned in different orientations on the frame, wherein the screen is selectively retained to the frame by hooks connected to a shaft that is rotatably mounted to the frame, where the hooks selectively engage and disengage a retaining bar mounted to the screen as the shaft is rotated, and the screen is selectively released from and retained on the frame by rotating the shaft, and a wear plate that can be selectively released from the frame without modification, such that the wear plate can be placed in different positions on the frame and aligned in different orientations on the frame.

2. The cradle system of claim 1, wherein the frame defines a leading grinding edge at one end of the frame, and the wear plate can be selectively retained on the frame in a first orientation where a first edge of the wear plate is toward the leading grinding edge, and a second orientation where the first edge of the wear plate is away from the leading grinding edge.

3. The cradle system of claim 1, wherein the frame defines a leading grinding edge at one end of the frame, and a trailing grinding edge at another end of the frame, and the wear plate can be selectively released from the frame at the leading grinding edge of the frame and selectively retained on the frame at the trailing grinding edge of the frame.

4. The cradle system of claim 1, wherein the frame can selectively retain a plurality of screens in a plurality of different positions on the frame, and any one of the screens can be placed and selectively retained in any one of the positions on the frame.

5. The cradle system of claim 1, wherein the wear plate is selectively retained to the frame by posts mounted on a back surface of the wear plate, which posts engage retaining sockets fixedly mounted to the frame.

6. The cradle system of claim 1, wherein the wear plate is sized to be carried by one person without assistance.

7. The cradle system of claim 1, wherein the screen is sized to be carried by one person without assistance.

8. A cradle system for a fragmenting machine, the cradle system for holding fragmentation stock against a drum, and comprising:

a frame having a leading grinding edge and a trailing grinding edge, retaining sockets fixedly mounted to the frame in a first position proximate the leading grinding edge and a second position proximate the trailing grinding edge, shafts rotatably mounted to the frame, each shaft having a series of hooks that rotate with the shaft as the shaft rotates, screens, each screen having at least one mounting rod, where each of the screens can be selectively placed into any one of different positions on the frame, and selectively retained on and released from the frame by rotating the shafts such that the hooks selectively engage and disengage the mounting rods, and a first wear plate having retaining posts that releasably engage the retaining sockets in the first position, and a second wear plate having retaining posts that releasably engage the retaining sockets in the second position, where the first and second wear plates are swappable between the first position and the second position.

9. The cradle system of claim 8, wherein each of the wear plates have a first edge, and the wear plates can both be rotated such that the first edge of each wear plate is selectively disposed toward one of the leading grinding edge and the trailing grinding edge.

10. The cradle system of claim 8, wherein each of the wear plates is sized to be carried by one person without assistance.

11. The cradle system of claim 8, wherein each of the screens is sized to be carried by one person without assistance.

* * * * *